US005793269A

United States Patent [19]

Ervasti et al.

[11] Patent Number: 5,793,269

[45] Date of Patent: Aug. 11, 1998

[54] STEPWISE REGULATED FILTER HAVING A MULTIPLE-STEP SWITCH

[75] Inventors: Kimmo Ervasti, Varjakka; Pertti Nissinen, Oulunsalo, both of Finland

[73] Assignee: LK-Products Oy, Kempele, Finland

[21] Appl. No.: 701,359

[22] Filed: Aug. 22, 1996

[30] Foreign Application Priority Data

Aug. 23, 1995 [FI] Finland ..... 953963

[51] Int. Cl.[6] ..... H01P 7/00; H01P 1/205; H01P 7/04

[52] U.S. Cl. ..... 333/235; 333/203; 333/223

[58] Field of Search ..... 333/202, 202 DB, 333/202 HR, 203, 205, 207, 219–219.1, 222–223, 235, 262

[56] References Cited

U.S. PATENT DOCUMENTS 4,502,029 2/1985 Reed ..... 333/202 X
5,107,233 4/1992 Stoft ..... 333/202 X
5,298,873 3/1994 Ala-Kojola ..... 333/235
5,594,395 1/1997 Niiranen ..... 333/202 X

*Primary Examiner*—Benny Lee
*Assistant Examiner*—Barbara Summons
*Attorney, Agent, or Firm*—Darby & Darby

[57] ABSTRACT

A stepwise regulated filter includes a resonator structure and a coupling connected to the resonator structure. The resonating frequency of a transmission line (HX1) acting as a resonator may be switched between at least three values. The switching is implemented using coupling elements (SL1, SL4) which are in an electromagnetic coupling (M2, M3) with the resonator (HX1). The potentials of the coupling elements (SL1, SL4) are affected by PIN diodes (D1, D2) acting as switches. A RF power signal, which is coupled from the resonator (HX1) to the coupling elements (SL1, SL4), is applied to both terminals of at least one diode (D1) with the same phase and power. Then the voltage across the diode (D1) cannot, in the blocking state, rise to a level that would cause undesirable mixing results or would damage the diode (D1).

20 Claims, 4 Drawing Sheets

STEPWISE REGULATED FILTER HAVING A MULTIPLE-STEP SWITCH

BACKGROUND OF THE INVENTION

1. Field of the Invention

The invention is related in general to radio frequency filters the frequency response of which can be altered with an electric signal, and in particular to the lifting of the pass and stop bands of a duplex filter from a frequency area to another using an electric circuit so that the operation of said circuit is as reliable and interference-free as possible.

2. Description of the Prior Art

Radio transceivers generally employ duplex filters based on transmission line resonators to prevent the transmitted signal from entering the receiver and the received signal from entering the transmitter. Each multichannel radio telephone network has a specified transmission and reception frequency band. Also the difference between the reception and transmission frequencies during connection, ie. the duplex interval, complies with the network specifications. The frequency difference between the pass and stop bands of an ordinary bandpass or bandstop filter is also called a duplex interval.

It is possible to design a suitable filter for each network. Current manufacturing methods enable flexible and economical production of different network-specific filters. Frequency adjustment systems, or so-called switching systems, are related to the segmentation of frequency bands, which means dividing a particular transmission and/or reception band into smaller parts. For example, in the NMT450 system, in which the width of a transmission or reception band is 4.5 MHz, the band may be segmented into three 1.5-MHz segments. The whole frequency band can be covered with one relatively small filter designed for one segment only, provided that the filter can be switched to the segment in use, ie. adjusted to operate on the narrower frequency area used.

Switching, or frequency adjustment of a filter is based on changing the specific impedance and, thus, the resonating frequency of transmission line resonators included in the filter. The specific impedance depends on the dimensions of the transmission line resonator and the grounded metal casing surrounding it as well as on regulation couplings arranged in the vicinity of the resonator. A method is known from the prior art for adjusting the resonating frequency of a transmission line resonator by arranging a transmission line near the transmission line resonator, thereby creating an electromagnetic coupling between the transmission line and the transmission line resonator, whereby the transmission line is called a coupling element. The electrical characteristics of the coupling element determine how the resonating frequency of the resonator is changed.

It is known to build a switched resonator, ie. one with a variable resonating frequency, by arranging in the vicinity of a coupling element a switch which, when closed, connects one end of the coupling element to the ground. Then the resonating frequency of the transmission line resonator is higher than when the switch is open. With one coupling element and a two-state switch connected with it, it is possible to change the resonating frequency of the resonator only from one value to another. Such a system is called two-step switching.

In addition, so-called multiple-step switching is known, wherein one frequency out of three or more alternatives can be selected as the resonating frequency. A conventional embodiment of such switching is disclosed in U.S. Pat. No. 5,298,873. A disadvantage of that solution is that each coupling element and switch takes some space in the vicinity of the resonator, whereby resonator and filters consisting of those resonators cannot be built very small. Nowadays, the size is very significant because such filters are used in small and lightweight mobile phones. Another disadvantage of using several coupling elements is that the electromagnetic coupling between the resonator and several coupling elements affects the resonator's Q-factor in proportion to the number of coupling elements used. Furthermore, in the manufacturing process there occurs certain deviation in the dimensioning of coupling elements, which results in variation in resonator characteristics, which is difficult to control.

These disadvantages are eliminated using constructions according to Finnish Patent Applications Nos. 951351 and 951352, wherein a regulating element is arranged between the transmission line resonators, comprising a switch, e.g. a coupling assembled using PIN diodes, which has at least three states. The three states of the switch correspond to different electrical characteristics of the regulating element and thereby different specific impedance values of the resonator structure and thereby different resonating frequencies.

When using PIN diodes in circuits in which power exceeds 100 mW, the most common problems are related to the mixing characteristics of the diodes. In addition to the desired power signal, the components of the transmitter chain of the radio device produce noise and undesired signals at various frequencies, or stray frequencies. Due to the properties of the PIN diodes used as switch components the power signal is mixed in them with the weaker stray frequency signals and noise, resulting in harmful mixing results. The problems caused by these mixing results are usually associated with a situation in which the diode is in the blocking state, which means that the bias voltage across the diode is set such that no current flows through the diode.

FIG. 1 shows a coupling according to the prior art, used for realizing three-step switching. It shows a resonator HX1 connected to the filter coupling (not shown) with a suitable method known to one skilled in the art. The RF power comes from the filter coupling to the resonator HX1 and is coupled therefrom via an electromagnetic coupling M2 to a coupling element (strip line) SL1. This produces a certain RF power level at the cathodes of diodes D1 and D2. From the radio frequency stand-point, the anodes of the diodes are almost at ground potential via capacitors C1 and C2. When the RF power at the cathodes of the diodes increases, the diodes begin to conduct during the negative half cycle of oscillating power, whereby their operation nearly corresponds to the operating principle of a mixer, which is known as a RF component. When the power increases enough, the current through the diode becomes so great that the diode might even be destroyed. One can say that upon exceeding a certain threshold power the diode is opened, even if it is not opened with a suitable bias voltage, whereby the RF power eventually destroys the diode.

When using such a stepwise regulated system in the transmitter branch of a duplex filter, a problem arises, as described above, in which the transmitter power is mixed with stray signals and noise. This causes undesired mixing results, the frequencies of which coincide in the worst case with the reception frequency, producing interference which affects the receiver's sensitivity or even blocks the whole receiver. An attempted solution to this problem was to determine that in the transmitter branch the frequencies of the reception band must have more attenuation, whereby the mixing results generally remain at a sufficiently low level. However, it was discovered that the problem gets worse when the ambient temperature increases. The temperature characteristics of the diodes, transmitter, duplex filter and the receiver are significant factors in this. For example, in the ambient temperature of +85° C., the receiver interference is a considerable problem.

SUMMARY OF THE INVENTION

An object of this invention is to provide a filter structure in which undesired mixing signals produced by switch components can be partly or totally avoided. Another object of the invention is to provide a filter structure in which the transmitter branch attenuation requirements for the reception band frequencies can be specified less rigorously than before. A further object of the invention is to provide a filter structure which is suitable for mobile phones and which can employ PIN diodes as switch components.

The resonator structure according to the invention which comprises a transmission line resonator, a first coupling element and a semiconductor switch having a first port and a second port, is characterized in that it also includes a second coupling element in order to provide a coupling to said transmission line resonator, and that said first coupling element is connected to said first port and said second coupling element is connected to said second port to couple a radio frequency signal from said first and second coupling elements to said semiconductor switch.

The invention is also directed to a method for reducing spurious effects in the resonator structure comprising a transmission line resonator and a regulating element influencing its specific impedance, which regulating element employs at least one semiconductor switch comprising a first and a second port. The method according to the invention is characterized in that a radio frequency signal connected from said transmission line resonator to said regulating element is taken to the first and second ports of said semiconductor switch with substantially the same power and phase.

The problem described above can be solved using a switched filter structure according to the present invention, wherein a RF power signal is applied to both terminals, ie. anode and cathode, of a diode acting as a switch component, with almost the same phase and power, whereby the voltage across the diode cannot rise to a level that would cause undesired mixing results. Thus, harmful mixing results can be attenuated down to a level which enables the use of diodes in hand phone filters, for example. Also, the "over-specification" of the attenuation of the reception band of the transmission filter becomes unnecessary.

An advantageous embodiment of the invention includes a second coupling element (advantageously a strip line), which is not contained in the solution according to the prior art and which is connected to a transmission line resonator via an electromagnetic coupling. When the RF power increases in the filter and, so, in the resonator, the power is connected via the first coupling element to the cathodes of the diodes and via the second coupling element to the anode of at least one diode. When the absolute value of the phase difference of the anode and cathode signals of the diodes is less than 90°, the voltage across the diode becomes lower than either of the anode or cathode voltages alone. Thereby, the mixing results of the diode remain small with respect to the power.

Compared to the prior art, the invention provides more interference-free reception because the stray frequencies and noise generated in the transmitter chain cannot cause disturbing mixing results at reception frequencies. In addition, the invention improves the reliability of a switched filter implemented with diode switches because in the arrangement according to the invention the switch diodes conduct and oscillate in the blocking state less than in corresponding arrangements according to the prior art, and therefore the diodes will not be destroyed as easily as before.

BRIEF DESCRIPTION OF THE DRAWINGS

The invention is described in greater detail by means of the advantageous embodiments disclosed here and with reference to the accompanying drawing in which.

DESCRIPTION OF THE PREFERRED EMBODIMENT(S)

Figure 1:
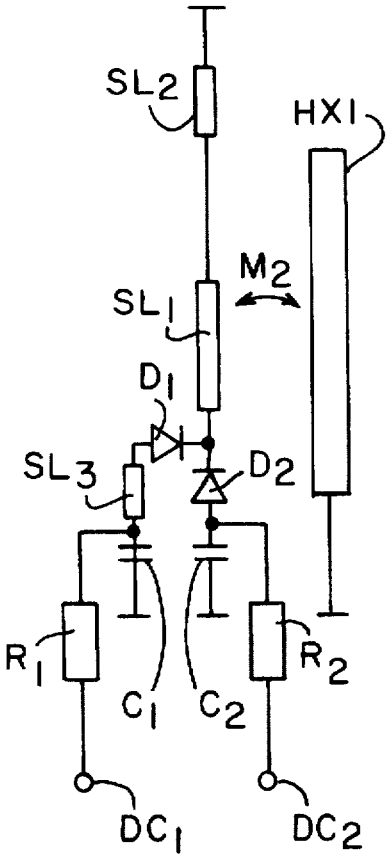
FIG. 1 PRIOR ART
FIG. 1 is a circuit diagram of a known coupling arrangement.

The known coupling arrangement shown in FIG. 1 was described above, so the invention will now be discussed with reference to FIGS. 2 to 5. In the figures, like parts are denoted by like reference numbers.

Figure 2:
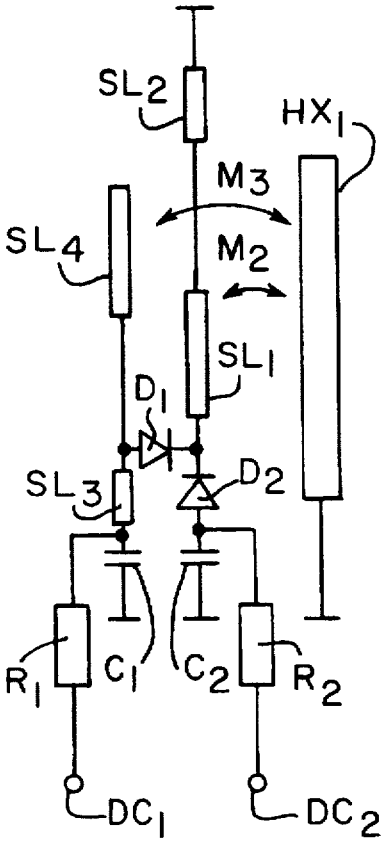
FIG. 2 is a circuit diagram of a coupling arrangement according to the invention.

FIG. 2 is a circuit diagram of an advantageous embodiment of the present invention. The circuit diagram shows a transmission line resonator HX1 and coupling elements SL1 and SL4 arranged in its vicinity, advantageously implemented as strip lines. The RF power comes to the resonator HX1 from the filter coupling (not shown) and is further connected via electromagnetic couplings M2 and M3 to the coupling elements SL1 and SL4. The RF power is connected to the cathodes of diodes D1 and D2 through the former, and to the anode of diode D1 through coupling element SL4. When the absolute value of the phase difference of the anode and cathode signals is smaller than 90°, the absolute value of the sum voltage across diode D1 is smaller than the absolute value of either of the voltages alone. Therefore, the mixing results of diode D1 remain small in relation to the power. If the absolute value of the phase difference were more than 90°, the voltage across the diode would become higher and the mixing results would become stronger. The coupling according to FIG. 2 employs the coupling according to the invention only for one diode D1, achieving a result good enough.

Many details of the structure affect the phase difference across diode D1: e.g. the location and distance of coupling elements SL1 and SL4 relative to the transmission line resonator HX1, and the length of the transmission lines leading from said coupling elements to the coupling pads of diode D1. In the optimum situation, where the phase difference is zero, the residue of the signal path length modulo the wavelength from the transmission line resonator HX1 via coupling element SL1 to the cathode of diode D1 equals the residue of the signal path length modulo the wavelength from the transmission line resonator HX 1 via coupling element SL4 to the anode of diode D1. Since the ratings of the parts also depend on other desired properties of the resonator structure, such as the degree of frequency shift produced with coupling elements and switch diodes, the phase difference usually cannot be set precisely to zero.

In the coupling according to FIG. 2, diodes D1 and D2 act as switches in a known manner, and their conductivity depends on the control voltages brought to bias ports DC1 and DC2. The control voltage, or bias voltage, brought to port DC1 affects diode D1 and the control, or bias voltage brought to port DC2 affects diode D2. A positive control voltage makes the diode conductive, in which state it can be compared to a closed switch. A negative or zero bias keeps the diode in the blocking state, in which it operates as an open switch, except for the partial conductivity during the negative half cycles, as described above.

Figure 3:
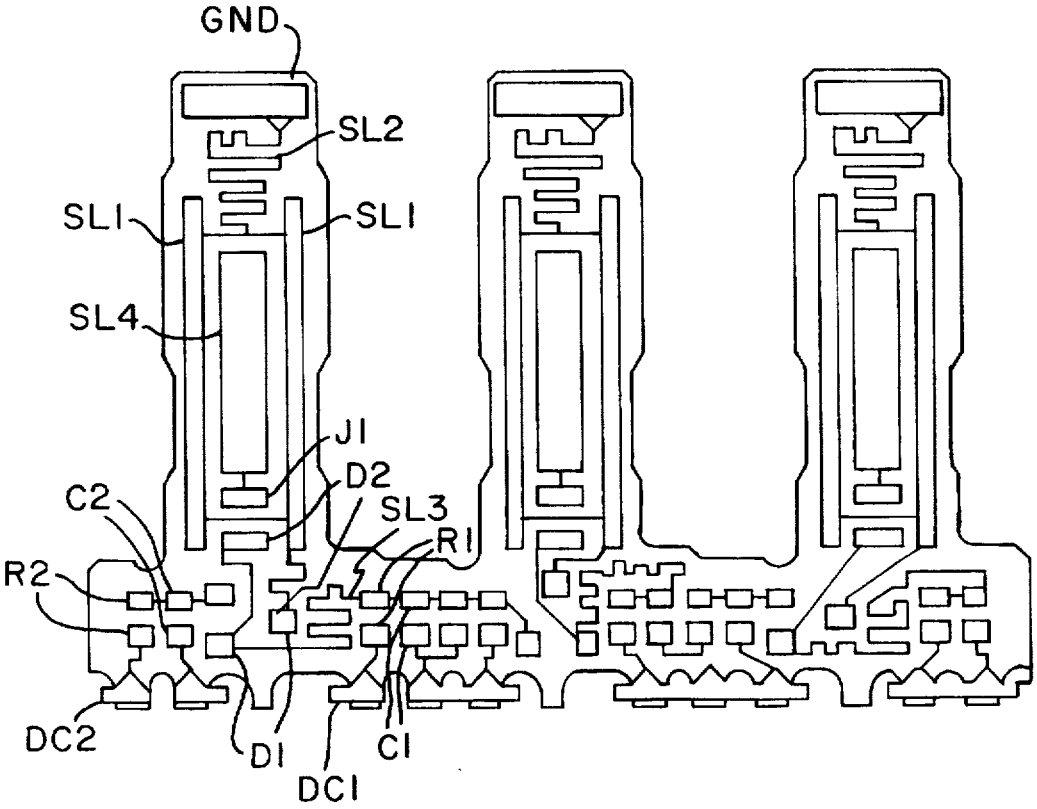
FIG. 3 shows the coupling according to the invention as implemented in the coupling plate of a comb-structured helix filter.

FIG. 3 shows a printed circuit board (pcb) used in the technical implementation of the embodiment according to FIG. 2. It is a pcb for a comb-structured helix filter, which is shown in FIG. 3 in broad outline, wherein each vertical branch is surrounded by a conductor wound into a cylindrical coil, or a helix resonator (not shown). The pcb made of a low-loss substrate serves as a supporting structure, or body, of the filter structure, and the conductors and coupling pads required for electrical operation are formed on its surface using a usual, widely known method. In the upper part of the branch there is a broad conductor GND which provides for the coupling element SL1 a galvanic coupling to the ground potential when the pcb and its resonators are installed in a known manner inside a casing made of an electrically conductive material. The frequency shifts are determined by means of dimensioning and locating transmission lines SL2 and SL3 as desired. A three-port component, which includes two PIN diodes in a common cathode coupling, is attached to diodes D1 and D2 below coupling element SL1. This component acts as a three-state switch so that the switching functions are realized with DC voltages, or bias voltages, connected to ports DC1 and DC2. Resistors R1 and R2 of FIG. 2 are located on the pcb connected to parts DC1 and DC2, and the bias voltages are brought to the switch circuit via these resistors. In addition, capacitors Cl and C2 of FIG. 2 are located on the pcb connected to diodes DC1 and DC2, and transmission line SL3 and the cathode of PIN diode D2 are connected to the ground potential via these capacitors.

In the embodiment according to FIG. 3, couplings M2 and M3 shown in FIG. 2 are formed by means of air from strip lines SL1 and SL4 directly to the helix resonator (not shown). The coupling employs a 0-ohm resistor, or jumper, connected to coupling pads J1 to connect strip line SL4 to the cathode of diode D1 across the transmission line connecting the various parts of strip line SL1.

Figure 4:
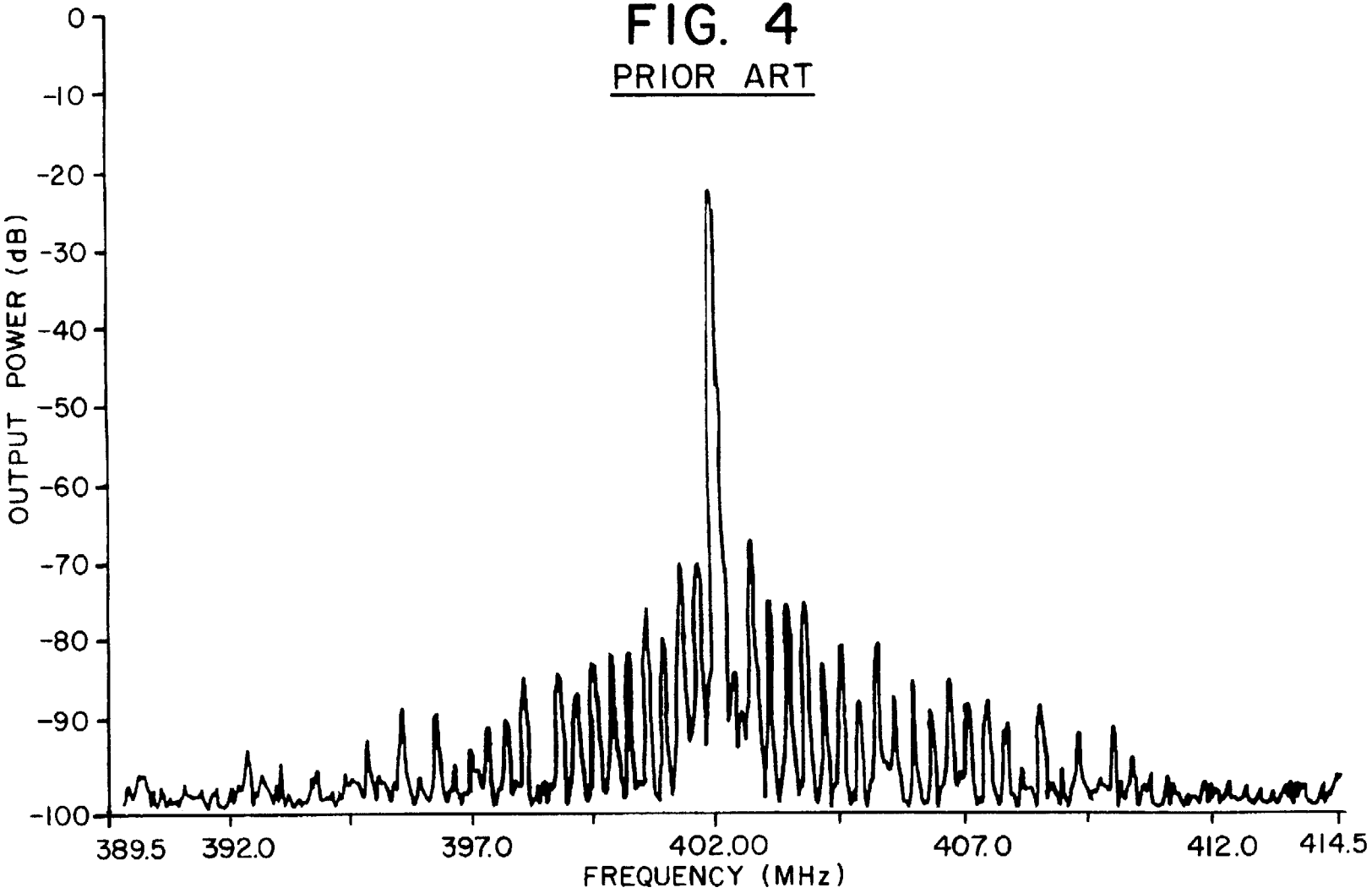
FIG. 4 PRIOR ART
FIG. 4 shows the response curve of a known coupling according the prior art with certain measurement arrangements.
Figure 5:
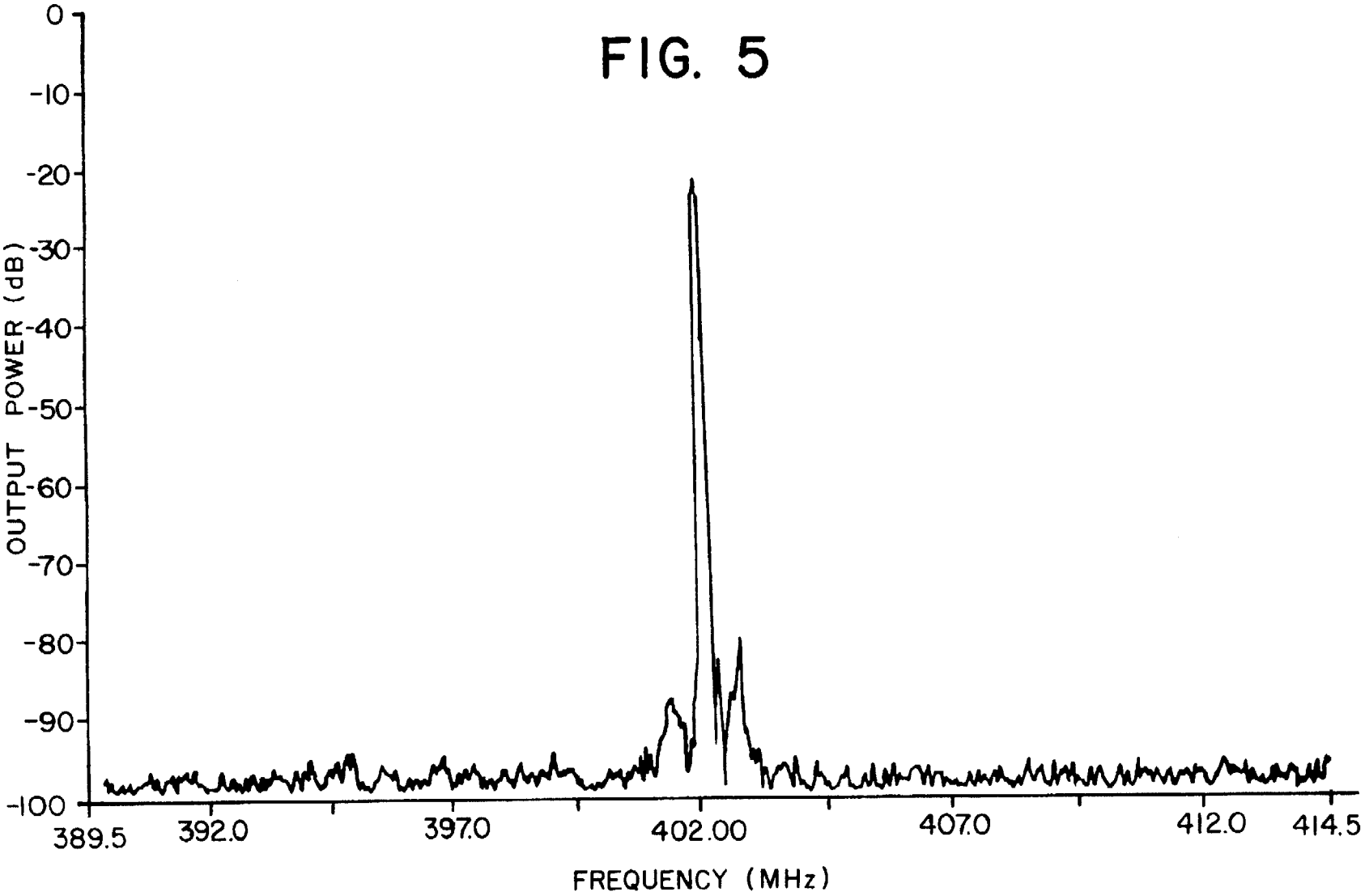
FIG. 5 shows the response curve of the coupling according to the invention with measurement arrangements corresponding to FIG. 4.

FIG. 4 shows a response curve of a known coupling and FIG. 5 the response curve of a coupling according to the invention, produced using the same measurement parameters. The figures clearly show the attenuation of the mixing result caused by the diodes in the coupling according to the invention.

With a coupling according to the invention, a helix filter, which is built around a pcb according to FIG. 3 and meant to be used in the transmitter branch of the duplexer of a 450-MHz hand phone, can tolerate an input power of up to 3 W in the ambient temperature of +85° C. This improvement in the power tolerance is considerable with respect to earlier filter circuits using diodes.

Above it was described how the implementation according to the invention is applied to a helix filter, in which the coupling according to the invention is realized only in one PIN diode, but it is clear that the coupling according to the invention can be applied to both diodes and, within the scope of the claims set forth below, also to other applications in which a radio frequency signal produces in a diode-like component undesired mixing results. Furthermore, in addition to a helix filter, it is possible to implement the coupling according to the invention in other filter structures, too, e.g. in ceramic filters. Then the resonator is a hole in the ceramic block, coated with an electrically conductive material, into which RF power is coupled from the filter circuit in a known manner. Coupling elements in a ceramic filter are advantageously implemented as strip lines on the surface of the ceramic piece constituting the body of the filter in the same manner as ordinary couplings connected to the filter circuit in ceramic filters of the prior art. The separate components required by the coupling according to the invention are advantageously connected to coupling pads formed on the surface of the ceramic piece.

It is also worth noticing that even though the diode mixing problems disclosed here become serious at powers exceeding 100 mW, the invention is in no way limited to powers exceeding that value, but it can also be used for powers less than 100 mW.

We claim:

1. A resonator structure comprising a transmission line resonator and a regulating element, wherein said regulating element can be used for changing the specific impedance of said resonator structure and, thus, the resonating frequency of the transmission line resonator, and wherein said regulating element includes a first coupling element to provide a first coupling to said transmission line resonator and a semiconductor switch which includes a first port and a second port, characterized in that said resonator structure also includes a second coupling element to provide a second coupling to said transmission line resonator and said first coupling element is connected to the first port of said semiconductor switch so as to be connected to a multiple-step switch, and said second coupling element is connected to the second port of said semiconductor switch in order to transmit a radio frequency signal from said first and second coupling elements to said semiconductor switch wherein an absolute value of the phase difference of the radio frequency signal across the semiconductor switch is less than 90 degrees.

2. The resonator structure of claim 1, characterized in that a residue of a signal path length modulo the wavelength of the signal path from said transmission line resonator to said first port via said first coupling element substantially equals the residue of the signal path length modulo the wavelength of the signal path from said transmission line resonator to said second port via said second coupling element, whereby the absolute value of the phase difference of the radio frequency signal across said semiconductor switch is less than 90 degrees.

3. The resonator structure of claim 1 or 2, characterized in that said semiconductor switch comprises, at least one diode and said first coupling element is connected to the cathode of said diode and said second coupling element is connected to the anode of said diode.

4. The resonator structure of claim 1 or 2, characterized in that said semiconductor switch comprises at least two diodes and said first coupling element is connected to the cathode of both diodes and said second coupling element is connected to the anode of a first of said diodes.

5. The resonator structure of claim 1 characterized in that said transmission line resonator is a cylindrical coil conductor constituting a helix resonator.

6. The resonator structure of claim 1, characterized in that said transmission line resonator is a hole in a dielectric block, coated with an electrically conductive material.

7. The resonator structure of claim 1, characterized in that it comprises a body substantially made of a dielectric material, and said first and second coupling elements are strip lines formed on the surface of said body.

8. A method for reducing spurious effects in a resonator structure comprising a transmission line resonator and a regulating element affecting the specific impedance of the transmission line resonator and employing at least one semiconductor switch which comprises a first and a second port, characterized in the steps of:

connecting a first coupling element to a multiple-step switch; and applying a radio frequency signal from said transmission line resonator and from said regulating element to the first and second ports of said semiconductor switch with substantially the same power and phases wherein an absolute value of the phase difference of the radio frequency signal across the semiconductor switch is less than about 90 degrees.

9. The method of claim 8, further comprising the step of:

substantially matching a first signal path length of a signal path from the transmission line resonator to the first port via the first coupling element and a second signal path length of a signal path from the transmission line resonator to the second port visa second coupling element, such that a residue of the first signal path length modulo the wavelength substantially equals a residue of the second signal path length modulo the wavelength, whereby the absolute value of the phase difference of the radio frequency signal across the semiconductor switch is less than about 90 degrees.

10. The method of claim 8, further comprising the step of:

reducing spurious mixing results in the semiconductor switch according to the phase difference of the radio frequency signal across the semiconductor switch.

11. The method of claim 8, further comprising the steps of:

connecting the first coupling element to the cathode of at least one diode of the semiconductor switch; and connecting the second coupling element to the anode of the at least one diode.

12. The method of claim 8, further comprising the steps of:

providing a semiconductor switch having at least two diodes;

connecting the first, coupling element to the cathode of both diodes; and connecting the second coupling element to the anode of a first of said diodes.

13. A resonator structure comprising:

a transmission line resonator;

a semiconductor switch having first and second ports;

a first coupling element providing a first electromagnetic coupling with the transmission line resonator;

a second coupling element providing a second electromagnetic coupling with the transmission line resonator; and a regulating element for changing the specific impedance of the resonator structure and the resonating frequency of the transmission line resonator, the regulating element including a multiple-step switch having a bias port for receiving a control voltage for controlling the switching of the multiple-step switch;

the first coupling element being connected to the first port of the semiconductor switch so as to be connected to the multiple-step switch, and the second coupling element is connected to the second port of the semiconductor switch in order to transmit a radio frequency signal from the first and second coupling elements to the semiconductor switch having an absolute value of the phase difference of the radio frequency signal across the semiconductor switch being less than about 90 degrees.

14. The resonator structure of claim 13 wherein the transmission line resonator is a cylindrical coil conductor.

15. The resonator structure of claim 13 wherein the transmission line resonator is a hole in a dielectric block.

16. The resonator structure of claim 13 further comprising:

a body made substantially of a dielectric material, and the first and second coupling elements being strip lines formed on a surface of the body.

17. The resonator structure of claim 13, wherein the phase difference of the radio frequency signal across the semiconductor switch reduces spurious mixing results in the semiconductor switch.

18. The resonator structure of claim 13 wherein a residue of a signal path length modulo the wavelength of the signal path from the transmission line resonator to the first port via the first coupling element equals the residue of the signal path length modulo the wavelength of the signal path from the transmission line resonator to the second port via the second coupling element, whereby the absolute value of the phase difference of the radio frequency signal across the semiconductor switch is less than 90 degrees.

19. The resonator structure of claim 13 wherein semiconductor switch further comprises:

at least one diode, the first coupling element being connected to the cathode of the diode and the second coupling element is connected to the anode of the diode.

20. The resonator structure of claim 13 the semiconductor switch further comprises at least two diodes, the first coupling element being connected to the cathode of both diodes and the second coupling element being connected to the anode of a first of said diodes.

* * * * *